US006053309A

United States Patent [19]

Lin

[11] Patent Number: 6,053,309

[45] Date of Patent: Apr. 25, 2000

[54] COMPRESSED FAR-SIGHTED EYEGLASSES WITHIN A CASE

[76] Inventor: Linus Lin, P.O. Box 90, Tainan City, Taiwan

[21] Appl. No.: 09/246,357

[22] Filed: Feb. 8, 1999

[51] Int. Cl.[7] ..... A45C 11/04

[52] U.S. Cl. ..... 206/6

[58] Field of Search ..... 206/5, 6

[56] References Cited

U.S. PATENT DOCUMENTS

| | | | |
|---|---|---|---|
| 1,919,262 | 7/1933 | Shields | 206/6 |
| 2,148,637 | 2/1939 | Oldham | 206/6 |
| 2,187,178 | 1/1940 | Schutz | 206/6 |
| 2,329,253 | 9/1943 | Churchill | 206/6 |
| 2,332,266 | 10/1943 | Segal | 206/6 |
| 2,446,966 | 8/1948 | Swikart | 206/6 |
| 2,809,766 | 10/1957 | Anderson | 206/6 |
| 3,825,110 | 7/1974 | Halbich et al. | 206/6 |

*Primary Examiner*—Bryon P. Gehman

[57] ABSTRACT

A pair of far-sighted eyeglasses with a case includes a case consisting of an upper half case and a lower half case, and a pair of far-sighted eyeglasses. The eyeglasses have two elastic temples with curved portions that protrude slightly beyond an upper edge of the lower half case when placed in the case such that the temples are compressed by the upper half case when the case is closed. When the upper half case is disengaged from the lower half case for opening, the upper half case is pushed away from the lower half case by the temples recovering the elasticity of the curved portions so as to facilitate the opening of the case, without the possibility of the eyeglasses falling out of the case during opening.

3 Claims, 6 Drawing Sheets

COMPRESSED FAR-SIGHTED EYEGLASSES WITHIN A CASE

BACKGROUND OF THE INVENTION

This invention relates to a pair of far-sighted eyeglasses with a case. In particular, the invention relates to a pair of eyeglasses having two curved, elastic temples.

Common conventional far-sighted eyeglasses are usually used for reading. As such, then cannot be always worn by users, but are only intended to be worn to read. So they are usually carried by users in a case having a hook closing mode. Since the case has to be opened with some force, if an excessive force is used to open the case, the pair of far-sighted eyeglasses contained in the case may fall out and down on the ground. In addition, the case may be large, thus not convenient to be carried by a user. Some far-sighted eyeglasses are collapsible to become a small size for easily carrying, having a turning point between the two lens frames a hang rod screwed with the sides of the lens frames. This permits the eyeglasses to be folded with one lens frame laid on the other lens frame, with the hang rod extending horizontal facing upward to form a T shape. Then the hang rod is folded down on the lens frames. The collapsed eyeglasses are then put into a curved case the size of a lighter. However, use of this kind of eyeglasses involves complicated steps.

SUMMARY OF THE INVENTION

This invention has been devised to offer a pair of far-sighted eyeglasses with a case, with the case having a simple structure to be easily opened, and with the contained eyeglasses not easily falling out of the case.

The invention is a case consisting of an upper half case and a lower half case pivotally connected with each other to allow the upper half case to be opened up and closed on the lower half case. Further, a soft cloth is laid on inner surface of the upper and lower half cases and a position block is provided in the lower half case for keeping a pair of far-sighted eyeglasses in place within the case around. In addition, two elastic temples of the far-sighted eyeglasses are curved to protrude slightly beyond an upper edge of the lower half case when the eyeglasses are contained in the case so that the upper half case compresses the two temples when the case is closed.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
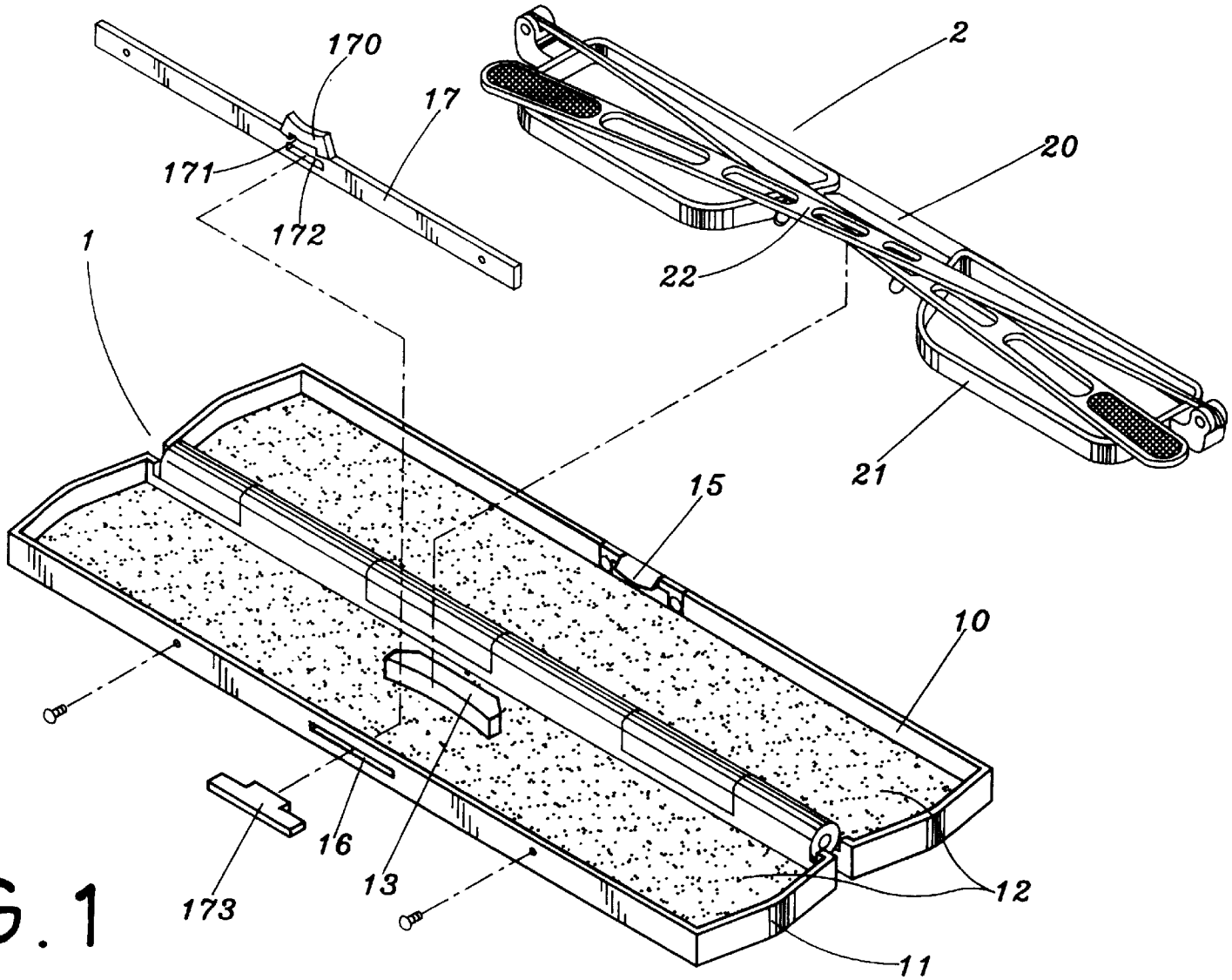
FIG. 1 is an exploded perspective view of far-sighted eyeglasses with a case according to the present invention.

A preferred embodiment of far-sighted eyeglasses with a case according to the Present invention, as shown in FIG. 1, includes a case 1, and a pair of far-sighted eyeglasses 2 as main components.

Figure 2:
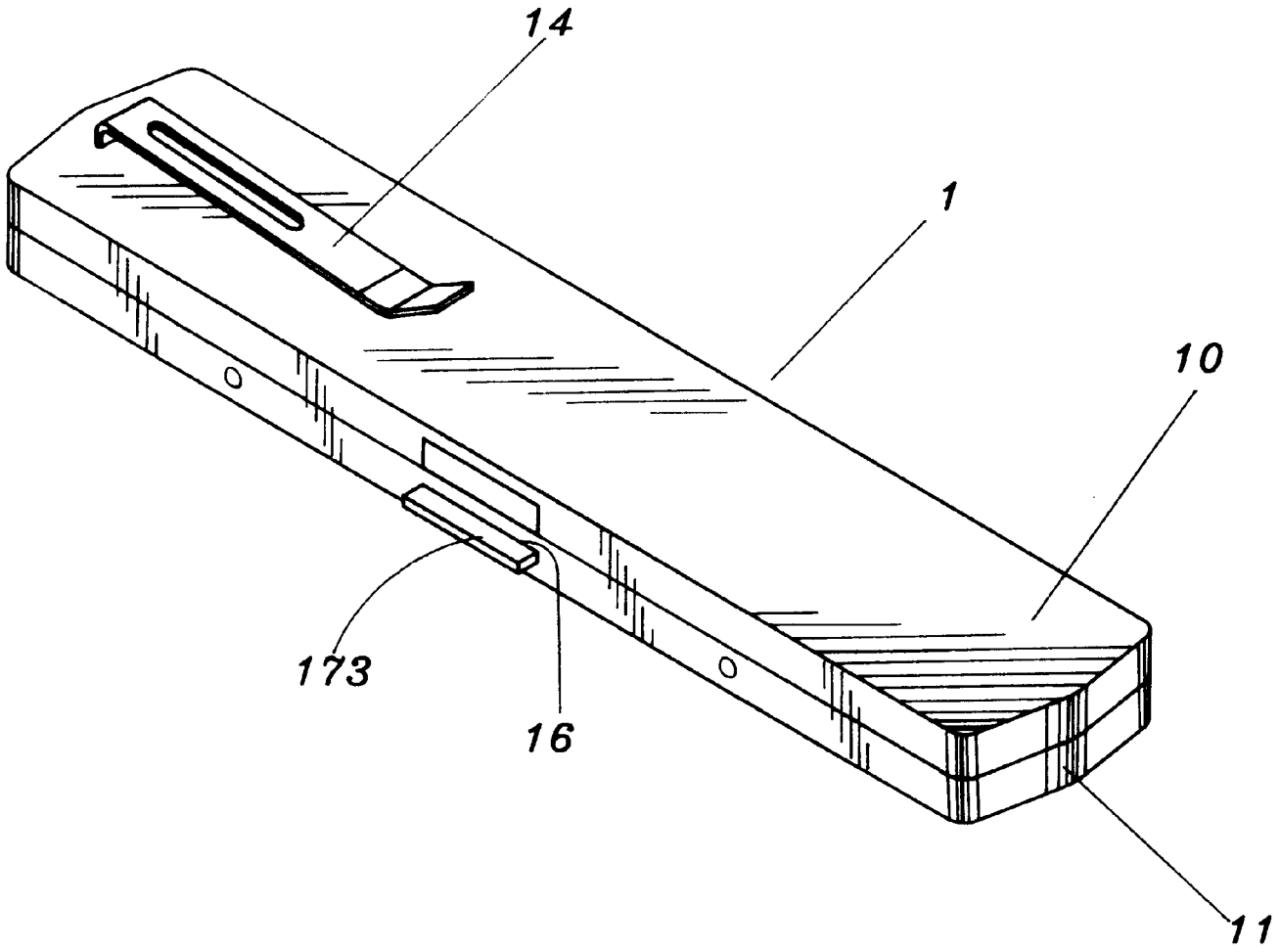
FIG. 2 is a perspective view of the case containing the far-sighted eyeglasses according to the present invention.
Figure 3:
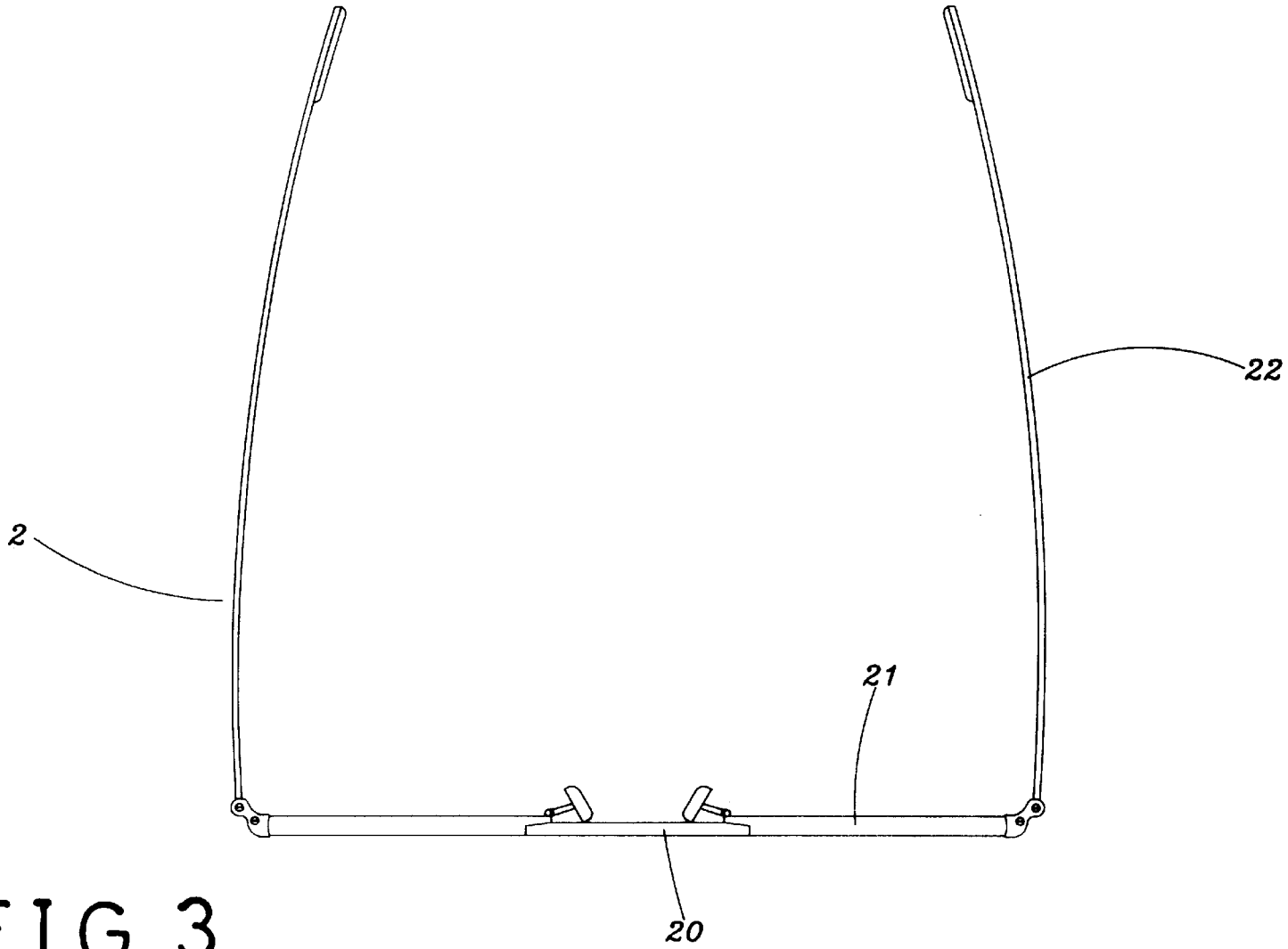
FIG. 3 is an upper view of the far-sighted eyeglasses according to the present invention.

The case 1 is elongate, consisting of an upper half case 10 and a lower half case 11, with the upper half case 10 foldably connected with the lower half case 11 so as to be opened and closed on the lower half case 11. Further, a sheet of soft cloth 12 is respectively laid in the upper and lower half cases 10 and 11 respectively, and the lower half case has a shaped position block 13 Placed on an intermediate portion of the inner surface. Further, a hang hook 14 is fixed on an outer surface of the upper half case 10, as shown in FIG. 2, for hanging the case 1 on a pocket. A hook 15 is provided on an intermediate portion of a front wall of the upper half case 10, and a slot 16 is provided in an intermediate portion a front wall of the lower half case 11. Further, a long elastic strip 17 is screwed onto an inner side of the front wall of the lower half case 11. The elastic strip 17 has a slide face 170 formed project upwards from an intermediate portion, an aperture 171 formed just under the slide face 170, and a slot 172 formed just under the aperture 171 for a push member 173 to fit therein and also extend out of the slot 16 of the lower half case 11.

The far-sighted eyeglasses 2 are to be placed in the case 1, having a central member 20 of a shape as shown in FIG 1, and a four sided lens frame 21 respectively at each side theory, and a flat curved temple 22 respectively connected to an outer side of each lens frame 21.

Figure 4:
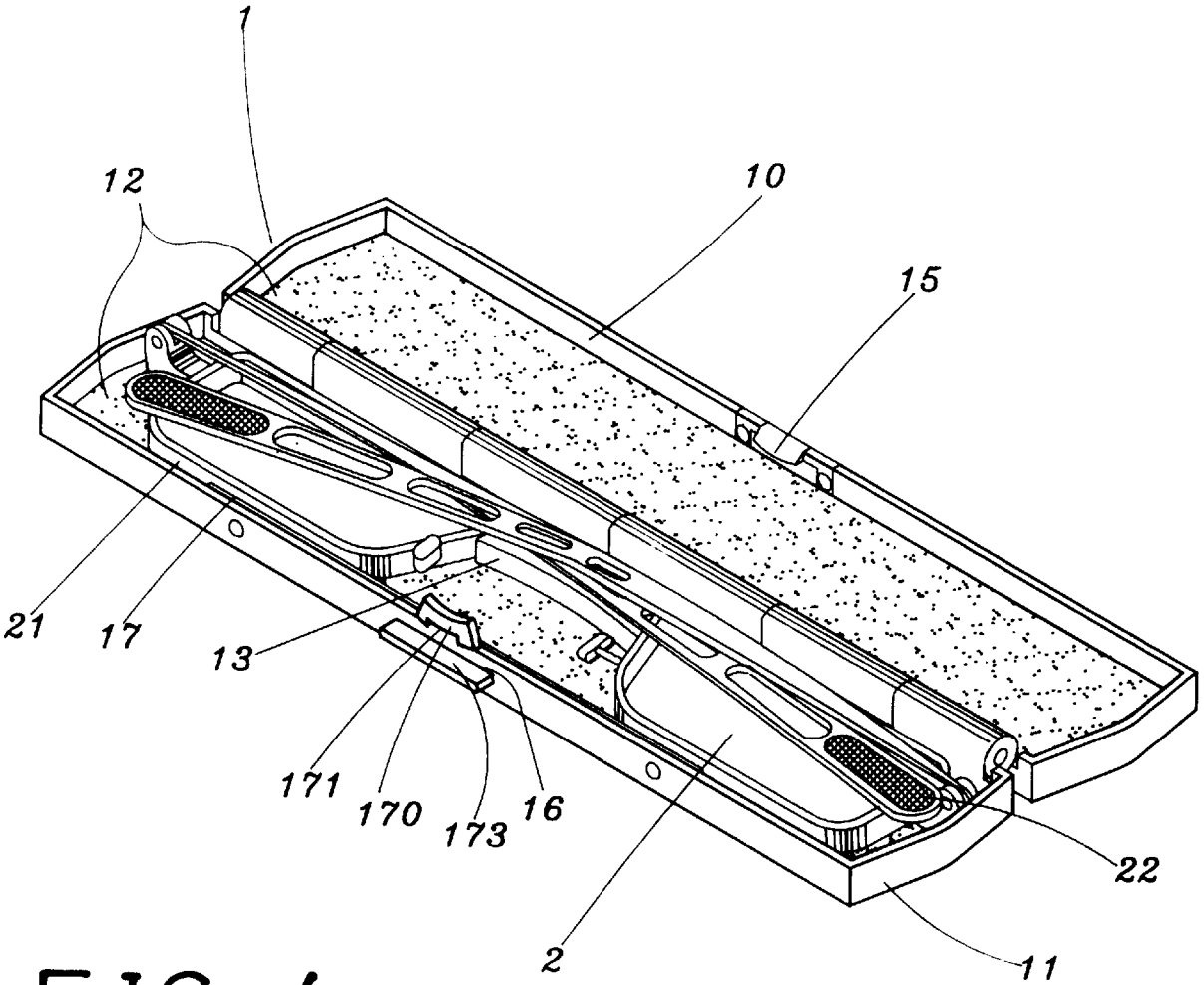
FIG. 4 is a perspective view of the far-sighted eyeglasses placed in a lower half case with an upper half case opened according to the present invention.
Figure 5:
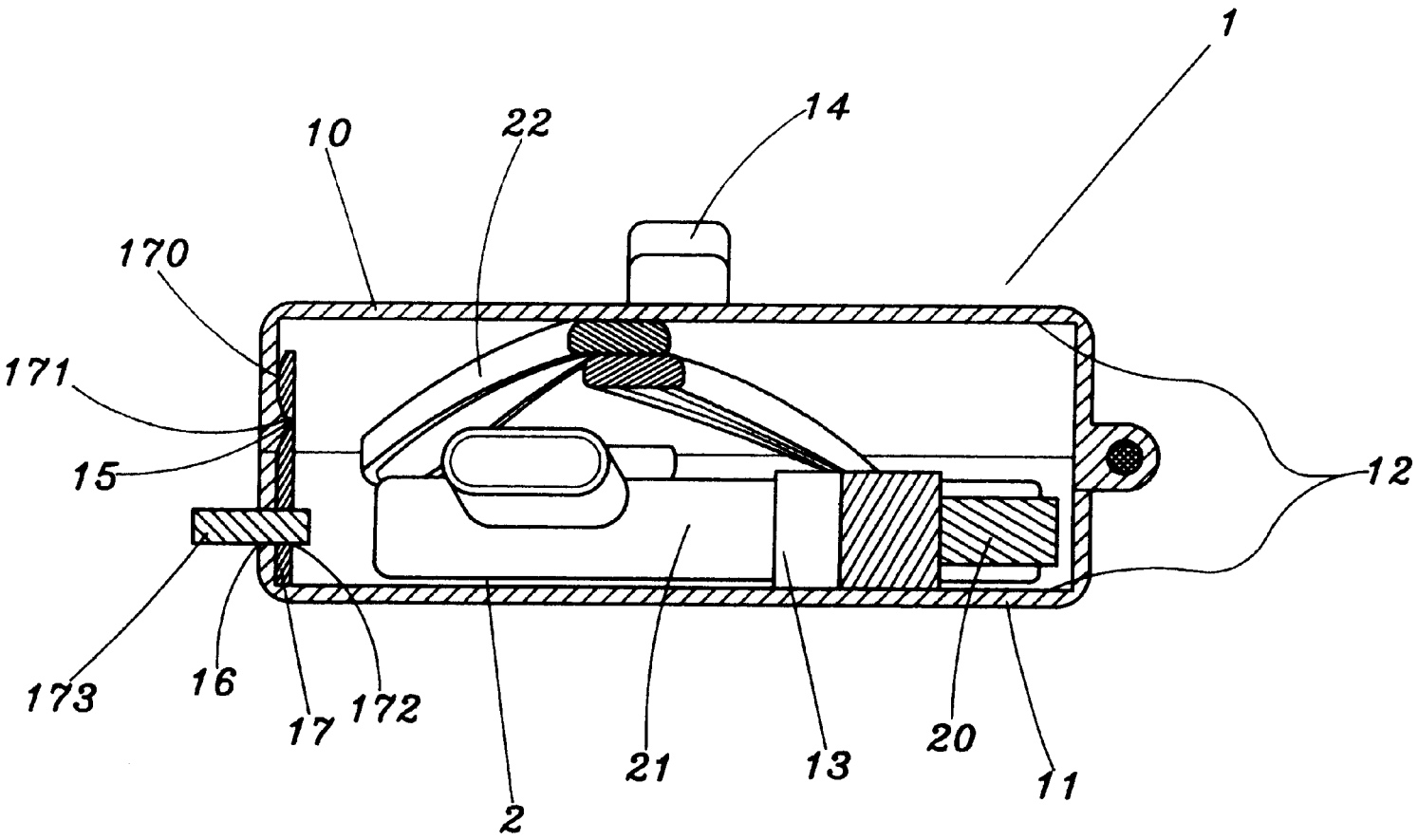
FIG. 5 is a cross-sectional view of the far-sighted eyeglasses placed according to the case in the present invention; and, FIG. 6 is a side view of the far-sighted eyeglasses folded and compressed according to the present invention.
Figure 6:
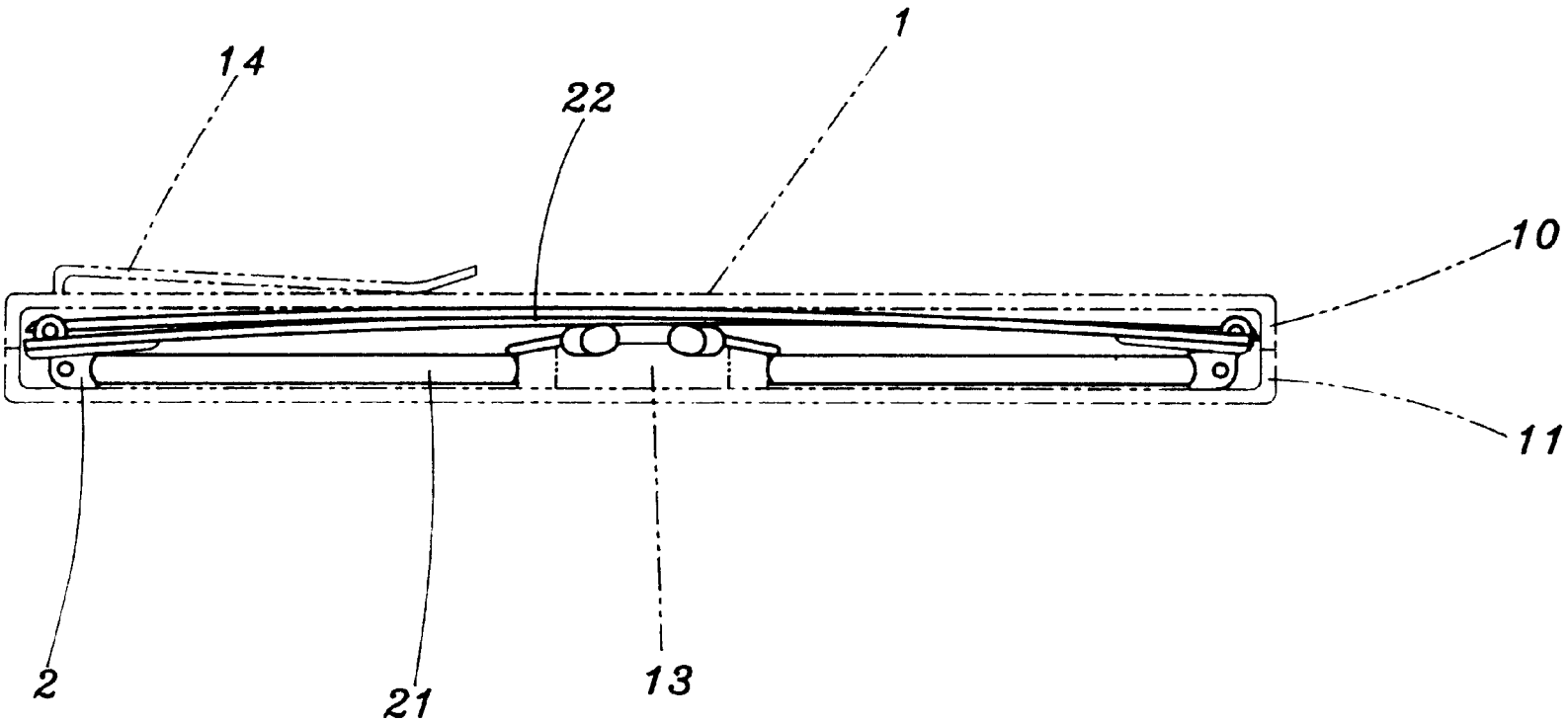

In assembling and using, referring to FIG. 4, firstly, the two temples 22 of the far-sighted eyeglasses 2 are folded down. The lens frames 21 are placed downward in the lower half case 11 protectively on the soft cloth 12, with the central member 20 of the eyeglasses 2 located adjacent and engaged by the position block 13 of the lower half case 11 so as to keep the eyeglasses immovable. When the upper half case 10 is pushed down to close on the lower half case 11, the hook 15 slides along the slide face 170 and engages the aperture 171 as shown in FIG. 5, closing the case 1. At the same time, since the temples are curved upwards and protrude slightly beyond the upper edge of the lower half case 11, the temples 22 are compressed by the upper half case 10 as shown in FIG. 6.

In opening the case 1, the push member 173 is pushed inward, forcing the elastic strip 17 to move back, with the aperture 171 also moving back to disengage from the hook 15 of the upper half case 10. With the upper half case 10 no longer compressing the temples 22, the temples 22 uncompress and elastically push up the upper half case 10 with recovered elasticity of their curved portions. Then, the upper half case 10 may be further separated from the lower half case 11 easily. Thus, the case 1 has a simple structure, very small to be carried, with the hang hook 14 permitting the case 1 to be hanged on a pocket of clothing of a user.

The far-sighted eyeglasses with a case according to the present invention has the following advantages:

1. The upper half case is easily pushed open away from the lower half case of the elasticity of the two curved temples, making the case easy to use.

2. The case has simpler components than the conventional eyeglasses case having an automatic elastic opening mode, utilizing elasticity of the components without using any additional elastic elements. Further, the case has a smaller size than the conventional cases and is easily hanged on a pocket with the hang hook.

While the preferred embodiment of the invention has been described above, it will be recognized and understood that various modifications may be made therein and the appended claims are intended to cover all such modifications which may fall within the spirit and scope of the invention.

What is claimed is:

1. A pair of far-sighted eyeglasses with a case comprising:

a case including an upper half case, a lower half case, a soft cloth laid in said upper and lower half cases, respectively, and a position block provided at a proper location in said lower half case; and a pair of far-sighted eyeglasses having two lens frames spaced apart by a central member and two elastic temples with curved portions, said curved portions of said two temples being located upside so as to protrude slightly beyond an upper edge of said lower half case when said far-sighted eyeglasses are placed in said case;

wherein said position block is arranged to keep said far-sighted eyeglasses positioned in said case by engagement with said central member and each of said lens frames, wherein said far-sighted eyeglasses are kept substantially stationary in said case by said soft cloth, and wherein said upper half case compresses said curved portions of said two temples when said upper half case is pressed down to close said case by engaging said lower half case, said compressed temples pushing up on said upper half case by their own elasticity such that when said upper half case is disengaged from said lower half case to open said case, said curved portions uncompress to move said upper half case away from said lower half case.

2. The far-sighted eyeglasses with a case according to claim 1, further comprising:

a hang hook fixed on an outer surface of said upper half case, said hang hook being arranged to hang said case on a pocket of clothing of a user.

3. The far-sighted eyeglasses with a case according to claim 1, further comprising:

a hook in an intermediate portion of a front side wall of said upper half case;

a slot in an intermediate portion of a front side wall of said lower half case;

a long elastic strip fixed on an inner side of said front side wall of said lower half case, said elastic strip having a slide face which protrudes upwardly, a hook hole formed just under said slide face and an insert hole formed just under said hook hole; and a push member arranged to fit in said insert hole of said elastic strip and to extend out of said slot of said lower half case.

* * * * *